US007181914B2

(12) United States Patent
Pidcock et al.

(10) Patent No.: US 7,181,914 B2
(45) Date of Patent: Feb. 27, 2007

(54) DIFFUSER FOR GAS TURBINE ENGINE

(75) Inventors: Anthony Pidcock, Derby (GB); Desmond Close, Derby (GB)

(73) Assignee: Rolls-Royce plc, London (GB)

( * ) Notice: Subject to any disclaimer, the term of this patent is extended or adjusted under 35 U.S.C. 154(b) by 645 days.

(21) Appl. No.: 10/602,610

(22) Filed: Jun. 25, 2003

(65) Prior Publication Data

US 2004/0011043 A1 Jan. 22, 2004

(30) Foreign Application Priority Data

Jul. 17, 2002 (GB) ..... 0216561.1

(51) Int. Cl.
*F02C 1/00* (2006.01)
*F02G 3/00* (2006.01)

(52) U.S. Cl. ..... 60/751; 415/211.2

(58) Field of Classification Search ..... 60/751; 415/211.2

See application file for complete search history.

(56) References Cited

U.S. PATENT DOCUMENTS

| | | | | |
|---|---|---|---|---|
| 2,966,028 | A * | 12/1960 | Johnson et al. | 137/15.1 |
| 2,975,587 | A * | 3/1961 | Rae | 138/44 |
| 3,299,632 | A * | 1/1967 | Wilde et al. | 60/746 |
| 3,589,127 | A * | 6/1971 | Kenworthy et al. | 60/39.37 |
| 3,877,221 | A | 4/1975 | Lefebvre | |
| 4,132,499 | A * | 1/1979 | Igra | 415/210.1 |
| 4,320,304 | A * | 3/1982 | Karlsson et al. | 290/55 |
| 4,416,111 | A * | 11/1983 | Lenahan et al. | 60/795 |
| 4,549,847 | A * | 10/1985 | Stroem et al. | 415/182.1 |
| 4,678,396 | A * | 7/1987 | Mowill | 415/148 |
| 5,077,967 | A * | 1/1992 | Widener et al. | 60/772 |
| 5,211,003 | A * | 5/1993 | Samuel | 60/772 |
| 5,249,921 | A * | 10/1993 | Stueber et al. | 415/138 |
| 5,279,126 | A * | 1/1994 | Holladay | 60/751 |
| 5,339,622 | A * | 8/1994 | Bardey et al. | 60/39.092 |
| 5,592,820 | A | 1/1997 | Alary | |
| 5,592,821 | A * | 1/1997 | Alary et al. | 60/751 |
| 5,619,855 | A * | 4/1997 | Burrus | 60/736 |
| 6,286,298 | B1 * | 9/2001 | Burrus et al. | 60/776 |
| 6,554,569 | B2 * | 4/2003 | Decker et al. | 415/192 |
| 6,564,555 | B2 * | 5/2003 | Rice et al. | 60/746 |
| 6,651,439 | B2 * | 11/2003 | Al-Roub et al. | 60/772 |
| 6,843,059 | B2 * | 1/2005 | Burrus et al. | 60/751 |
| 2002/0092303 | A1 | 7/2002 | Al-Roub | |

FOREIGN PATENT DOCUMENTS

| | | |
|---|---|---|
| EP | 0 120 173 | 10/1984 |
| EP | 0 491 478 | 6/1992 |

* cited by examiner

*Primary Examiner*—William H. Rodriguez
(74) *Attorney, Agent, or Firm*—W. Warren Taltavull; Manelli Denison & Selter PLLC

(57) ABSTRACT

A gas turbine engine pre-diffuser 40 is generally annular, including radially inner and radially outer walls 40 and 42 and a generally cylindrical midline 48 defined between the walls. The pre-diffuser 40 includes a central member 46 which forces air flowing through the pre-diffuser 40 to separate, initially to be directed away from the midline 48 before subsequently being allowed to diffuse back towards the midline 48. The majority of the diffusion takes place on the walls of the central member and is thus in an inner region of the annulus of air ejected from the pre-diffuser to pass to the combustor. Any boundary losses therefore do not significantly effect air at the extremities of this annulus, this air being destined for the annuli of the combustor and requiring relatively high energy levels.

13 Claims, 3 Drawing Sheets

PRIOR ART

DIFFUSER FOR GAS TURBINE ENGINE

FIELD OF THE INVENTION

The invention relates to a gas turbine engine pre-diffuser, for diffusing airflow received from the engine's compressor as the air flows axially through the engine towards the combustor.

BACKGROUND OF THE INVENTION

A gas turbine engine includes a compressor having one or more stages of rotating blades for compressing air entering the engine. The compressed air enters an annular combustor where a fuel and air mixture is ignited. Hot gases leaving the combustor provide propulsive force for the engine and power a turbine, also having one or more stages of rotating blades. The turbine stages are connected to corresponding compressor stages by respective interconnecting shafts such that the turbine powers the compressor.

The gas turbine engine requires the air exiting the compressor to be distributed to annular channels located radially inwardly and outwardly of the combustor. Conventionally, a diffuser is used to effect such distribution.

The compressed air discharged from the compressor flows at a relatively high velocity and conventionally a pre-diffuser is utilised for initially decreasing the velocity of the compressed airflow to minimise subsequent pressure losses. The pre-diffuser is generally annular, including radially outer and radially inner walls between which the air flows. The radially outer wall is generally frustoconical, flaring outwardly in the downstream direction towards the combustor. The radially inner wall is also generally frustoconical but narrows in the downstream direction. The radially outer and radially inner walls thus diverge away from one another in the downstream direction, such that the area of an inlet of the pre-diffuser is smaller than the area of its outlet. The ratio between the pre-diffuser inlet and the pre-diffuser outlet is typically around 1.5. As the air enters the pre-diffuser, its flow velocity therefore reduces, the larger the area ratio of the outlet to the inlet, the lower the velocity of the air leaving the pre-diffuser. The air leaving the pre-diffuser enters a "dump region" where further deceleration occurs before the air is directed to the annular channels surrounding the combustor.

In a conventional gas turbine engine, around 40% of the air leaving the compressor is passed to the radially outer annular channel (annulus) around the combustor. A further 40% is passed to the radially inner annulus of the combustor. Some of this air is subsequently passed through mixing ports in the combustor walls to thereby enter the combustor for mixing with fuel and burning, some of the air is used for cooling the combustor walls and for passing to the downstream turbines, also for cooling purposes. The remaining 20% of the airflow is passed directly into the combustor at an upstream end thereof.

The air flows that feed the combustor annuli originate from the root and tip regions of the compressor, and flow through the radially outer and inner parts of the pre-diffuser. This air tends to suffer pressure losses along the walls of the pre-diffuser, with most losses occurring in a boundary layer adjacent to those walls. The boundary layer is relatively thin and, where 40% of the airflow is passed to each annuli, the effect of this pressure loss is not very significant because overall pressure losses in the pre-diffuser are low.

However it is now proposed that, to deliver engines that produce reduced NOx emissions, lean burn combustion processes should be used. These processes involve passing much less air down the annuli. In a lean burn combustor, the annuli typically only take around 15% of the compressor delivery air per annulus. There is a danger that much of these small amounts of annulus airflow will come from the root and tip regions of the high pressure compressor. This is the air which suffers pressure losses in the pre-diffuser, being air from the boundary layers. This may result in there being an apparent high pre-diffuser loss from the compressor exit to the combustor annuli, when compared to conventional rich burn combustors with much larger annulus flows.

SUMMARY OF THE INVENTION

According to the invention, there is provided a pre-diffuser for a gas turbine engine, for location between a compressor and a combustor of the engine to receive air flowing therebetween, the pre-diffuser being generally annular, including radially inner and radially outer walls and a generally cylindrical midline defined between the walls, wherein the pre-diffuser is shaped to include a first upstream portion in which air flowing through the pre-diffuser is directed away from the midline and a second downstream portion in which air flowing through the pre-diffuser is directed at least partially towards the midline of the pre-diffuser.

Preferably the pre-diffuser includes a generally annular central member located between the radially inner and radially outer walls, airflow through the pre-diffuser being forced to separate and pass around the central member.

Preferably the central member includes an upstream portion which includes radially outer and radially inner walls, each diverging away from the midline of the pre-diffuser in the downstream direction, causing air flowing around the upstream portion of the central member to be directed away from the midline of the pre-diffuser. The walls may be angled at between 20° and 90° to one another.

Preferably a pathway for air is defined between the racially outer wall of the pre-diffuser and the radially outer wall of the upstream portion of the central member. The respective radially outer walls of the pre-diffuser and of the upstream portion of the central member may converge in the downstream direction, for accelerating air flowing therebetween.

Preferably a pathway for air is defined between the radially inner wall of the pre-diffuser and the radially inner wall of upstream portion of the central member. The respective radially inner walls of the pre-diffuser and of the upstream portion of the central member may converge in the downstream direction, for accelerating air flowing therebetween.

The central member may further include a downstream portion including radially outer and radially inner walls, each converging towards the midline of the pre-diffuser in the downstream direction, allowing air flowing therearound to diffuse towards the midline of the pre-diffuser. The walls may be angled at between 10° to 40° to one another. The walls may meet at their downstream ends.

Preferably a pathway for air is defined between the radially outer wall of the pre-diffuser and the radially outer wall of the downstream portion of the central member, the respective walls of the pre-diffuser and the central member diverging in the downstream direction, for diffusing air flowing therebetween.

Preferably a pathway for air is defined between the radially inner wall of the pre-diffuser and the radially inner wall of the downstream portion of the central member, the respective walls of the pre-diffuser and the central member diverging in the downstream direction, for diffusing air flowing therebetween.

The radially inner and outer walls of the pre-diffuser may be substantially coaxial. Alternatively the radially inner and outer walls may diverge in the downstream direction, being angled at up to about 10° to one another. Preferably the radially inner and outer walls of the pre-diffuser diverge at a lesser angle than do the radially inner and outer walls of the upstream part of the central member.

According to the invention there is further provided a gas turbine engine including a pre-diffuser according to any of the preceding nine paragraphs, the gas turbine engine including a generally annular combustor. Preferably the combustor is surrounded by radially inner and radially outer annuli each receiving air flowing from the pre-diffuser. Preferably the pre-diffuser and combustor are shaped such that less than 20% of the air exiting the pre-diffuser is directed down each of the radially inner and radially outer annuli. Preferably around 15% of the air leaving the pre-diffuser is directed down the radially outer annulus and 15% down the radially inner annulus.

BRIEF DESCRIPTION OF THE DRAWINGS

An embodiment of the invention will be described for the purpose of illustration only with reference to the accompanying drawings in which.

DESCRIPTION OF THE INVENTION

Figure 1:
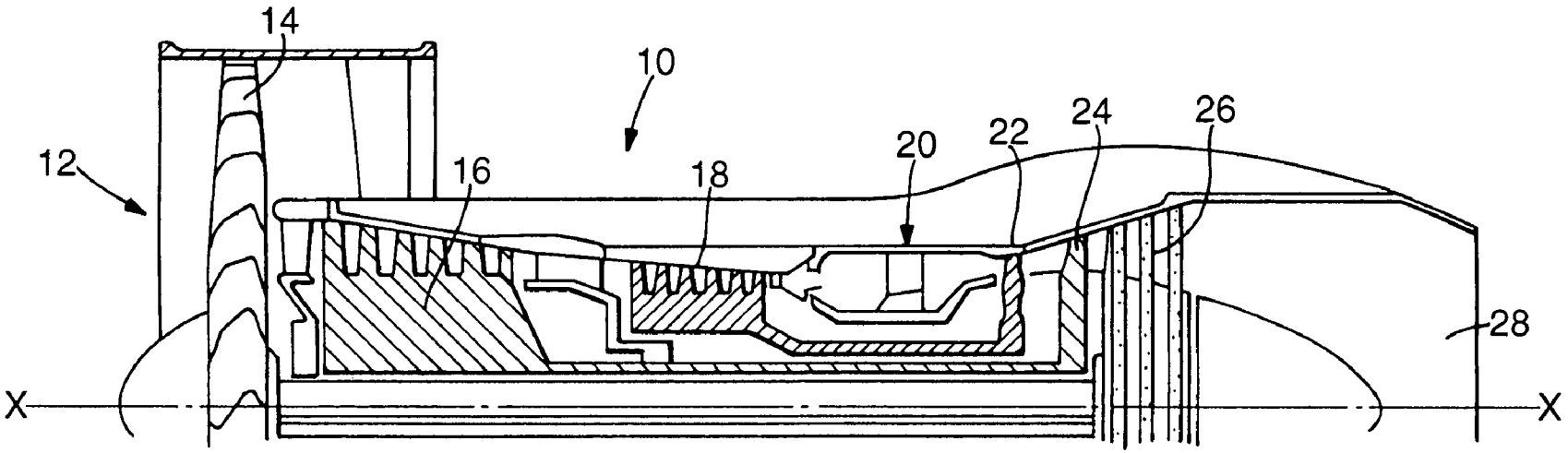
Fig.1. PRIOR ART
FIG. 1 is a sectional side view of the upper half of a gas turbine engine.

With reference to FIG. 1, a ducted fan gas turbine engine generally indicated at 10 has a principal axis X—X. The engine 10 comprises, in axial flow series, an air intake 12, a propulsive fan 14, an intermediate pressure compressor 16, a high pressure compressor 18, combustion equipment 20, a high pressure turbine 22, an intermediate pressure turbine 24 and a low pressure turbine 26. An exhaust nozzle 28 is provided at the downstream, tail end of the engine 10. The gas turbine engine 10 works in the conventional manner so that air entering the intake 12 is accelerated by the fan 14 to produce two airflows: a first airflow into the intermediate pressure compressor 16 and a second airflow which provides propulsive thrust. The intermediate pressure compressor 16 compresses the airflow redirected into it before delivering that air to the high pressure compressor 18 where further compression takes place.

The compressed air exhausted from the high pressure compressor 18 is directed into the combustion equipment 20 where is it mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and loans pressure turbines 22, 24 respectively drive the high and intermediate pressure compressors 16 and 18 and the fan 14 by suitable interconnecting shafts.

Figure 2:
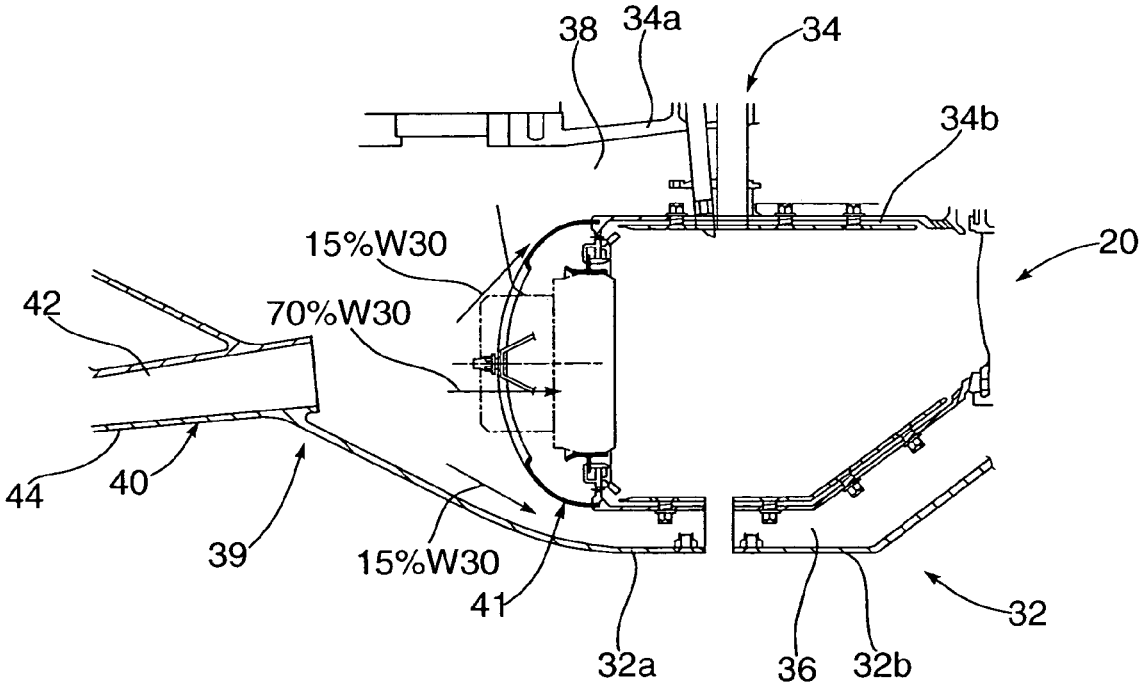
FIG. 2 is a sectional side view of part of a combustor of a gas turbine engine of FIG. 1 together with a conventional pre-diffuser, viewed in a circumferential direction.

Referring to FIG. 2, a conventional lean burn combustor 20 includes an annular combustion chamber 30 having radially inner and radially outer wall structures 32 and 34 respectively.

The inner and outer wall structures 32 and 24 each comprise an exterior wall 32*a*, 34*a* and an interior wall 32*b*, 34*b*. An annulus 36 is defined between the two walls of the inner wall structure 32 and an annulus 38 is defined between the two walls of the outer wall structure 34.

Air leaving the high pressure compressor is directed towards and into the combustion equipment 20 for combustion. In the lean burn combustor illustrated in FIG. 2, approximately 15% of the air leaving the high pressure compressor is directed into the inner wall structure annulus 36, about 15% of the air is directed into the outer wall structure annulus 38 and the remaining 70% of the air is directed straight into the combustion chamber 30.

Air is directed from the high pressure turbine to the combustor 20 via a diffuser including a pre-diffuser 40 and a dump diffuser 41. FIG. 2 illustrates a conventional pre-diffuser which is generally annular, including a radially outer wall 42 and a radially inner wall 44. The walls diverge away from one another in the downstream direction, to reduce the velocity of air exiting the high pressure compressor, without causing flow separation.

Figure 3:
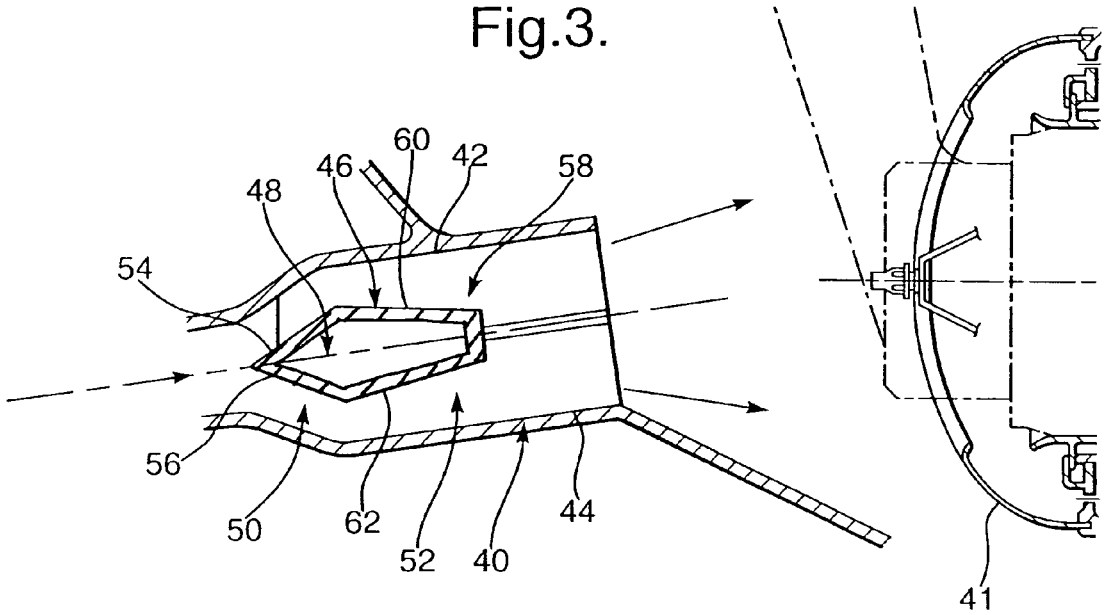
FIG. 3 is a similar view to that of FIG. 2 but illustrating a pre-diffuser according to the invention.

FIG. 3 illustrates a pre-diffuser 40 according to the invention. This pre-diffuser 40 is also generally annular in overall shape, including a radially outer wall 42 and a radially inner wall 44. The pre-diffuser further includes a central member 46 which is also generally annular in overall shape and which is located between the radially outer and inner walls 42 and 44. A midline 48 of the pre-diffuser is defined between the radially inner and outer walls, the central member 46 spanning this midline. FIG. 3 illustrates a section of just one part of the generally annular pre-diffuser, such that the midline 48 appears one dimensional. Of course however the midline 48 for the whole pre-diffuser would be generally cylindrical. Air passes through the pre-diffuser in the axial direction of the engine, as indicated by the arrows.

The central member 46 forces air flowing through the pre-diffuser 40 to separate into two concentric annuli. Air in each annulus is first directed by the central member 46 away from the midline 48 of the pre-diffuser, and subsequently allowed to move back towards the midline 48 of the pre-diffuser as it flows in the downstream direction. This is described in more detail below.

The central member 46 of the pre-diffuser 40 includes an upstream portion 50 which is generally V shaped in profile, when viewed in the circumferential direction as illustrated in FIG. 2. This portion consists of a radially outer wall 54 which diverges in the downstream direction, being generally frustoconical in shape, and a radially inner wall 56 which is also generally frustoconical and which converges in the downstream direction. A passageway for air is defined between the outer wall 54 of the upstream portion 50 of the central member 46, and the outer wall 42 of the pre-diffuser. These two walls may converge towards one another slightly in the downstream direction or may be generally parallel. Air flowing through this passageway is directed away from the midline 48 of the pre-diffuser and may be slightly accelerated, if the walls converge. Air flowing between the radially inner wall of the upstream portion of the central member 46 and the inner wall 44 of the pre-diffuser is similarly directed away from the midline 48 of the pre-diffuser.

The central member 46 also includes a downstream portion 58 which also includes radially outer and radially inner walls 60 and 62 respectively. Both of these walls are generally frustoconical, the outer wall converging in the downstream direction and the inner wail diverging in the downstream direction. A passageway is defined between the outer wall 60 of the downstream portion of the central member 46 and the outer wall 42 of the pre-diffuser. The walls of this passageway diverge and air passing through is therefore diffused.

Air flowing through the pre-diffuser 40 is first forced around the upstream cart 50 of the central member 46, and thus directed away from the midline 48 of the pre-diffuser. The air is subsequently allowed to flow back towards the midline 48, as it is gradually diffused by the diverging walls 60 and 42, and 62 and 40. The walls 60 and 62 of the central member 46 are relatively strongly angled in comparison with the walls 42 and 44, and therefore the majority of the diffusion of the airflow takes place on the walls of the central member. Generally therefore any boundary layer growth will tend to occur within an inner region (near the midline 48) of the annulus of air ejected from the ore-diffuser and passing to the combustion equipment 20. This means that the air at the radially outer and radially inner extremities of the annulus of air will be relatively fast moving. This is the air destined for the annuli of the combustor and the air which is required to posses a relatively high velocity in order to pass to and through the annuli and on to the turbines downstream.

There is thus provided a pre-diffuser which achieves relatively large area ratios between outlet and inlet in a reasonable length and at the same time reduces the pressure losses in the wall boundary layers at the radially inner and radially outer edges of the annulus of air.

By careful design of the shape of the upstream portion of the pre-diffuser, it is possible to deliver un-separated flow to the downstream, diffusing portion.

Figure 4:
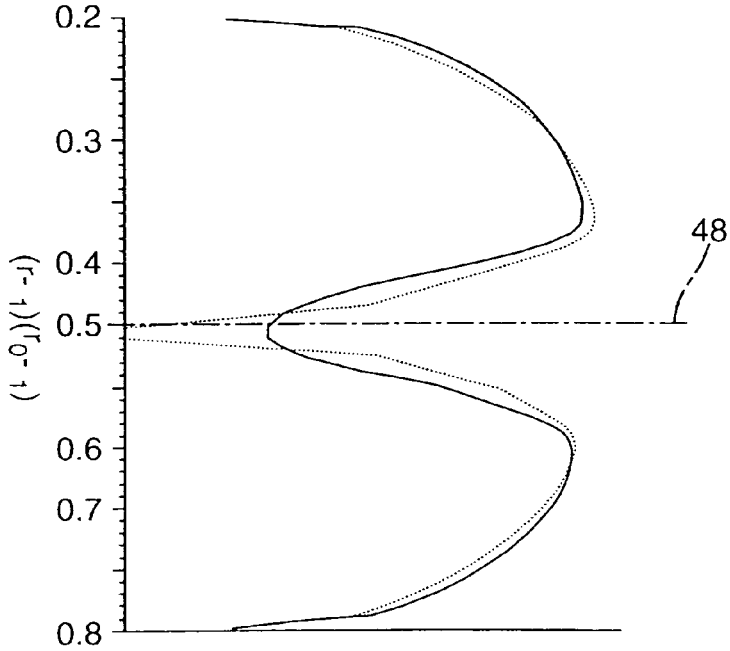
FIG. 4 is a diagrammatic graph illustrating the exit velocity profile of air leaving the pre-diffuser according to the invention.

FIG. 4 illustrates the velocity profile of air leaving the pre-diffuser 40. The position of the midline 48 is shown. It may be seen that the low velocity air is in the central area of the annulus of air. The air making up the 15% at the extremities of the annulus has a reasonably high average velocity.

Various modifications may be made to the above described embodiment without departing from the scope of the invention. In particular, the radially inner and radially outer walls of the downstream portion of central member 46 may converge together to eventually meet, rather than ending more abruptly as illustrated FIG. 3. Various different shapes may be used depending upon the precise application. Also, the precise shapes of the various other parts of the pre-diffuser may be modified depending upon the application.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A pre-diffuser for a gas turbine engine, for location between a compressor and a combustor of the engine to receive air flowing therebetween, the pre-diffuser being generally annular, including radially inner and radially outer walls and a generally cylindrical midline defined between the walls, wherein the pre-diffuser is shaped to include a first upstream portion in which air flowing through the pre-diffuser is directed away from the midline and a second downstream portion in which air flowing through the pre-diffuser is directed at least partially towards the midline of the pre-diffuser.

2. A pre-diffuser according to claim 1, including a generally annular central member located between the radially inner and radially outer walls, airflow through the pre-diffuser being forced to separate and pass around the central member.

3. A pre-diffuser according to claim 2, wherein the central member includes an upstream portion which includes radially outer and radially inner walls, each diverging away from the midline of the pre-diffuser in the downstream direction, causing air flowing around the upstream portion of the central member to be directed away from the midline of the pre-diffuser.

4. A pre-diffuser according to claim 3, wherein the radially inner and outer walls of the central member are angled at between 20° and 90° to one another.

5. A pre-diffuser for a gas turbine engine, for location between a compressor and a combustor of the engine to receive air flowing therebetween, the pre-diffuser being generally annular, including radially inner and radially outer walls and a generally cylindrical midline defined between the walls, wherein the pre-diffuser is shaped to include a first upstream portion in which air flowing through the pre-diffuser is directed away from the midline and a second downstream portion in which air flowing through the pre-diffuser is directed at least partially towards the midline of the pre-diffuser wherein the pre-diffuser further includes a generally annular central member located between the radially inner and radially outer walls, airflow through the pre-diffuser being forced to separate and pass around the central member wherein the central member includes an upstream portion which includes radially outer and radially inner walls, each diverging away from the midline of the pre-diffuser in the downstream direction, causing air flowing around the upstream portion of the central member to be directed away from the midline of the pre-diffuser wherein a pathway for air is defined between the radially outer wall of the pre-diffuser and the radially outer wall of the upstream portion of the central member, the respective radially outer walls converging in the downstream direction, for accelerating air flowing therebetween.

6. A pre-diffuser according to claim 5, wherein a pathway for air is defined between the radially inner wall of the pre-diffuser and the radially inner wall of upstream portion of the central member, the respective radially inner walls converging in the downstream direction, for accelerating air flowing therebetween.

7. A pre-diffuser according to claim 6, wherein the central member further includes a downstream portion including radially outer and radially inner walls, each converging towards the midline of the pre-diffuser in the downstream direction, allowing air flowing therearound to diffuse towards the midline of the pre-diffuser.

8. A pre-diffuser according to claim 7, wherein the radially inner and outer walls of the central member are angled at between 10° and 40° to one another.

9. A pre-diffuser according to claim 8 wherein a pathway for air is defined between the radially outer wall of the pre-diffuser and the radially outer wall of the downstream portion of the central member, the respective walls of the pre-diffuser and the central member diverging in the downstream direction, for diffusing air flowing therebetween.

10. A pre-diffuser according to claim 9 wherein a pathway for air is defined between the radially inner wall of the pre-diffuser and the radially inner wall of the downstream portion of the central member, the respective walls of the pre-diffuser and the central member diverging in the downstream direction, for diffusing air flowing therebetween.

11. A pre-diffuser according to claim 10 wherein the radially inner and outer walls of the pre-diffuser diverge at a lesser angle than do the radially inner and outer walls of the upstream part of the central member.

12. A gas turbine engine including a pre-diffuser according to claim 1, the gas turbine engine including a generally annular combustor.

13. A pre-diffuser for a gas turbine engine, for location between a compressor and a combustor of the engine to receive air flowing therebetween, the pre-diffuser being generally annular, including radially inner and radially outer walls and a generally cylindrical midline defined between the walls, wherein the pre-diffuser is shaped to include a first upstream portion in which air flowing through the pre-diffuser is directed away from the midline and a second downstream portion in which air flowing through the pre-diffuser is directed at least partially towards the midline of the pre-diffuser, the gas turbine engine including a generally annular combustor surrounded by radially inner and radially outer annuli each receiving air flowing from the pre-diffuser, and wherein the pre-diffuser and combustor are shaped such that less than 20% of the air exiting the pre-diffuser is directed down each of the radially inner and radially outer annuli.

* * * * *